US010471436B2

(12) United States Patent
Enderle et al.

(10) Patent No.: US 10,471,436 B2
(45) Date of Patent: Nov. 12, 2019

(54) PRELIMINARY SIZE REDUCTION DEVICE FOR A BALL MILL OR AGITATOR BALL MILL AND BALL MILL WITH A PRELIMINARY SIZE REDUCTION DEVICE

(71) Applicant: NETZSCH-Feinmahltechnik GmbH, Selb (DE)

(72) Inventors: Udo Enderle, Arzberg (DE); Theron Harbs, Selb (DE); Holger Moeschl, Selb (DE); Lars-Peter Weiland, Schonwald (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 828 days.

(21) Appl. No.: 15/055,843

(22) Filed: Feb. 29, 2016

(65) Prior Publication Data

US 2016/0199846 A1 Jul. 14, 2016

Related U.S. Application Data

(63) Continuation of application No. PCT/DE2014/000492, filed on Oct. 1, 2014.

(30) Foreign Application Priority Data

Oct. 14, 2013 (DE) ..... 10 2013 111 297

(51) Int. Cl.
*B02C 19/08* (2006.01)
*B02C 17/18* (2006.01)
(Continued)

(52) U.S. Cl.
CPC ..... *B02C 17/183* (2013.01); *B02C 2/10* (2013.01); *B02C 17/16* (2013.01); *B02C 17/18* (2013.01); *B02C 19/08* (2013.01); *B02C 23/38* (2013.01)

(58) Field of Classification Search
CPC ..... B02C 2/10; B02C 19/08; B02C 23/38; B02C 17/183; B02C 17/18; B02C 17/16
(Continued)

(56) References Cited

U.S. PATENT DOCUMENTS 1,021,950 A * 4/1912 Shepard ..... B02C 13/26 241/248
1,159,138 A * 11/1915 Vecchini ..... B02C 2/10 241/162
(Continued)

FOREIGN PATENT DOCUMENTS

DE 217434 A1 1/1985
DE 102008058585 * 5/2010 ..... B02C 17/16
(Continued)

OTHER PUBLICATIONS

Theron, DE 102008058585 English Translation, 2009.*
(Continued)

*Primary Examiner* — Adam J Eiseman
*Assistant Examiner* — Bobby Yeonjin Kim
(74) *Attorney, Agent, or Firm* — Whitmyer IP Group LLC

(57) ABSTRACT

A preliminary size reduction device for a ball mill or agitator ball mill and a ball mill with a preliminary size reduction device, wherein the preliminary size reduction device is disposed between a grinding stock inlet of the ball mill or agitator ball mill and a grinding chamber and includes a first size reduction mechanism constituted stationary and a second, rotationally mobile size reduction mechanism, between which a size reduction gap is formed. The first size reduction mechanism constituted stationary is a size reduction ring disposed in the grinding container.

15 Claims, 5 Drawing Sheets

(51) Int. Cl.
*B02C 23/38* (2006.01)
*B02C 2/10* (2006.01)
*B02C 17/16* (2006.01)

(58) Field of Classification Search
USPC ..... 241/169.1, 260, 152.2, 162–163, 170
See application file for complete search history.

(56) References Cited

U.S. PATENT DOCUMENTS 3,952,958 A * 4/1976 Rich ..... B02C 2/10 241/162
4,203,558 A * 5/1980 Schnitzer ..... A47J 42/06 241/247
4,406,571 A * 9/1983 Ross ..... B02C 2/10 241/260.1
4,613,086 A * 9/1986 Granum ..... A21C 1/12 241/101.2
4,634,061 A * 1/1987 Williams ..... A47J 42/06 241/101.01
5,145,121 A * 9/1992 Erkinger ..... D21B 1/14 241/248
7,478,772 B2 * 1/2009 Wang ..... A47J 31/00 241/224
8,028,943 B2 * 10/2011 Harbs ..... B02C 17/161 241/171
8,815,319 B2 * 8/2014 Zapp Glauser ..... A21D 2/36 426/243
8,895,094 B2 * 11/2014 Zapp Glauser ..... A21D 8/06 426/103
8,939,390 B2 * 1/2015 Machovina ..... A47J 43/07 241/260.1
2009/0134255 A1 * 5/2009 Tang ..... A47J 36/02 241/107

FOREIGN PATENT DOCUMENTS

DE 102008058585 A1 5/2010
EP 1980323 A1 10/2008

OTHER PUBLICATIONS

International Search Report Application No. PCT/DE2014/000492 Completed: Feb. 6, 2015; dated Feb. 19, 2015 2 pages.
Written Opinion of the International Searching Authority Application No. PCT/DE2014/000492 Completed: Apr. 23, 2015 5 pages.

* cited by examiner

PRELIMINARY SIZE REDUCTION DEVICE FOR A BALL MILL OR AGITATOR BALL MILL AND BALL MILL WITH A PRELIMINARY SIZE REDUCTION DEVICE

TECHNICAL FIELD

The present invention relates to a preliminary size reduction device for a ball mill or an agitator ball mill and a ball mill with a preliminary size reduction device according to the features of the claimed invention.

BACKGROUND

The invention relates to a preliminary size reduction device for a ball mill or an agitator ball mill and a ball mill with a preliminary size reduction device. The ball mill is a device for the coarse, fine and extremely fine size reduction or homogenisation of grinding stock. It comprises a grinding chamber which is caused to rotate and in which grinding stock is size-reduced by grinding bodies. Ball mills usually comprise an approximately circular-cylindrical grinding container mounted horizontally rotatable. The mills are filled through a central opening at one of the end walls, the so-called grinding stock inlet. The output is dependent on the design and takes place for example via slots in the grinding chamber wall at the end of the mill, wherein the grinding bodies are held back by a separating device.

A special form of the ball mill is the agitator ball mill. Agitator ball mills comprise a vertically or horizontally disposed, usually approximately cylindrical grinding container, which is filled 70-90% with grinding bodies. The grinding chamber is usually mounted stationary, non-rotating, in the case of agitator ball mills. An agitator with suitable agitator elements provides for the intensive motion of the grinding bodies. The grinding stock suspension is continuously pumped through the grinding chamber. The suspended solids are size-reduced or dispersed by impact or shearing forces between the grinding bodies. The separation of grinding stock and grinding bodies takes place by means of a suitable separating device at the exit from the mill.

Document DD 217434 B1 describes a vertically disposed agitator ball mill, which comprises in the upper inlet region a preliminary size reduction device connected to the agitator shaft. Said preliminary size reduction device comprises a crushing cone, which is disposed rotationally fixed on the agitator shaft, and a crushing ring fixed to the grinding container. The grinding stock is introduced into the crushing gap between the crushing cone and the crushing ring and thereby undergoes preliminary size reduction, before it falls into the grinding container, in which it is worked further by the agitator shaft and the grinding bodies.

Document DE 102008058585 A1 discloses an agitator ball mill with a horizontally disposed grinding chamber and an agitator shaft, wherein a preliminary size reduction device is provided between the grinding stock inlet and the grinding chamber, said preliminary size reduction device comprising a gap protection to the grinding chamber. This thus prevents grinding bodies from being able to flow back and get into the preliminary size reduction device.

EP 1980323 B1 describes a cutting system with a cutting rotor, which comprises rotor bars, at the outwardly facing surfaces whereof rotor cutting plates with cutting edges are fixed. A stator ring with an annular base and stator bars is disposed around the cutting rotor. The stator bars each comprise an inwardly facing stator recess with a stator cutting plate. The stator cutting plates are each disposed and fixed such that they each lie opposite the rotor cutting plates.

The problem underlying the invention is to improve the preliminary size reduction of solid constituents of grinding stock, in particular to make available a preliminary size reduction device, wherein the problem of jamming of coarse particles and/or impurities is reduced or minimised.

The above problems are solved by a preliminary size reduction device for ball mills and/or agitator ball mills and a ball mill with a preliminary size reduction device.

SUMMARY

The invention relates to a preliminary size reduction device for a ball mill or an agitator ball mill. The preliminary size reduction device is disposed in the grinding container between a grinding stock inlet of the ball mill or agitator ball mill and a grinding chamber and serves in particular to perform a preliminary size reduction of the grinding stock, so that the grinding stock entering into the grinding chamber now preferably only comprises constituents with a predetermined maximum size. The preliminary size reduction device comprises a first size reduction means constituted stationary and a second, rotationally mobile size reduction means, between which a size reduction gap is formed. The first size reduction means constituted stationary is in particular a size reduction ring disposed in the grinding chamber.

According to the invention, the first size reduction means constituted stationary comprises an inner toothing system. The second size reduction means comprises a first sub-region and a second sub-region. The size reduction gap is formed in particular between the first size reduction means constituted stationary and the first sub-region of the second size reduction means. The second sub-region of the second size reduction means comprises guiding structures for the grinding stock. The guiding structures serve in particular to feed the grinding stock entering via the grinding stock inlet in the direction of the first sub-region of the second size reduction means and therefore in the direction of the size reduction gap of the preliminary size reduction device formed between the size reduction ring and the first sub-region.

The first sub-region of the second size reduction means comprises a first outer toothing system. The first size reduction means and the second size reduction means are disposed in such a way that the outer toothing system of the first sub-region of the second size reduction means for the most part engages into the inner toothing system of the first size reduction means, in particular the size reduction ring, thereby forming the size reduction gap. The size reduction gap forms a minimum distance between the inner toothing system and the outer toothing system. The inner and outer toothing system can for example be constituted largely in a form-fit manner with respect to one another. However, the teeth are spaced apart from one another by the minimum distance of the size reduction gap, i.e. the teeth of the two size reduction means do not touch one another.

According to a preferred embodiment, the guiding structures of the second sub-region of the second size reduction means are constituted by a coarse outer toothing system of this sub-region. In particular, the second sub-region comprises a second outer toothing system with second outer teeth, which have a second tooth height and width. The second tooth height and width is greater than a first tooth height and width of the aforementioned first outer teeth in the first sub-region of the second size reduction means.

The coarse outer toothing system in particular has a tooth width of the individual teeth which increases from a free end of the second sub-region, as viewed in the direction of the adjacent first sub-region. Alternatively and/or additionally, the tooth height of the second outer teeth can also diminish in the direction of the adjacent first sub-region. The description of the tooth shape relates in particular to the outer surfaces of the second outer teeth.

According to an embodiment of the invention, the sides that delimit the outer surface of the second outer teeth have a curved course. In particular, one of the two sides has a more marked curvature, as a result of which the widening of the outer surfaces of the second outer teeth in the direction of the adjacent first sub-region is formed.

According to an embodiment, the first outer toothing system of the first sub-region of the second size reduction means extends over the outer surfaces of the second outer toothing system of the second sub-region, i.e. the second sub-region has constituted a so-called double toothing system, wherein the outer surfaces of the coarse outer toothing system have a superposed fine toothing system. The fine toothing system essentially corresponds to the first outer toothing system of the first sub-region of the second size reduction means.

According to a particularly preferred embodiment, the second sub-region of the second, rotationally mobile size reduction means is constituted as a truncated cone-like region with a truncated cone bottom face and a truncated cone top face. The first sub-region can be constituted as a largely cylindrical region with a cylindrical bottom face. Alternatively, the first sub-region could also be constituted as a truncated cone-like region. The truncated cone bottom face of the second sub-region and the cylindrical bottom face of the first sub-region are largely identical. The largely cylindrical region with a cylindrical bottom face lies adjacent to the truncated cone bottom face of the truncated cone-like region. In this embodiment, the first outer toothing system with first outer teeth having a first tooth height and width is assigned to the largely cylindrical region. The first outer teeth are constituted corresponding to the inner teeth of the inner toothing system of the first size reduction means, in particular to the inner teeth of the inner toothing system of the size reduction ring. The first size reduction means and the second size reduction means are disposed in such a way that the outer toothing system of the cylindrical region for the most part engages into the inner toothing system of the first size reduction means, thereby forming the size reduction gap, wherein the size reduction gap forms a minimum distance between the inner toothing system and the outer toothing system.

The truncated cone-like region of the second size reduction means comprises a second outer toothing system with second outer teeth in the region of the outer lateral surface between the truncated cone top face and the truncated cone bottom face. The second outer teeth have a second tooth height and width, which is greater than the first tooth height and width of the first outer teeth in the cylindrical region of the second size reduction means. Furthermore, provision can be made such that the tooth width of the second outer teeth increases from the truncated cone top face in the direction of the cylindrical region and/or that the tooth height of the second outer teeth diminishes in the direction of the cylindrical region. In particular, the sides or edges, which each delimit the outer surface of the outer teeth, have a curvature. In particular, one of the sides is curved more markedly, as a result of which the widening of the second outer teeth in the direction of the cylindrical region arises. The first outer toothing system of the cylindrical region of the second size reduction means is preferably continued over the second outer toothing system of the truncated cone-like region of the second size reduction means.

The present invention relates to a device for the preliminary size reduction of coarse constituents, in particular nuts, in the inlet region of a ball mill or agitator ball mill, in particular in the region between the grinding stock inlet and the grinding chamber. The ball mill or agitator ball mill serves in particular to grind wet grinding stock, but can also be used for a dry grinding operation. The preliminary size reduction device is in particular constituted in two parts and comprises a size reduction ring constituted stationary and a size reduction means disposed in a mobile manner, in particular rotatable. The size reduction ring comprises an inner toothing system in the region of the inner lateral surface The size reduction means comprises a first region with first teeth having a first material thickness and/or material height and a second region with first and second teeth having a first material thickness and/or material height of the first teeth and a second material thickness and/or material height of the second teeth. The first material thickness and/or material height is preferably smaller than the second material thickness and/or material height. In particular, the first material thickness and/or material height of the teeth of the size reduction means correspond to the material thickness and/or material height of the inner teeth of the size reduction ring. The second teeth of the size reduction means are constituted much thicker in the entrance region of the preliminary size reduction device than the first teeth of the size reduction means in the region of a size-reduction or crushing ring.

The second coarse teeth in the second region of the size reduction means also have a tapering tooth shape. In particular, the tooth shape tapers in the direction of the free end region of the truncated cone-like size reduction means facing away from the size reduction ring or in the direction of the top face of the size reduction means constituted as a truncated cone.

As a result of the larger second teeth of the size reduction means, coarse particles can be better picked up and undergo preliminary size reduction. The entire preliminary size reduction device is constituted and disposed between the grinding stock inlet and the grinding chamber in such a way that as far as possible no dead space is formed, in order to avoid the jamming of coarse particles and/or impurities. The invention finds particular use in ball mills or agitator ball mills for producing chocolate mass, fillings for chocolate and other foodstuffs. The invention is however also suitable for other products to be ground and can also be used for grinding stock suspensions or, with suitable dimensioning, also for the preliminary size reduction of grinding stock in mining etc.

The novelty in the invention thus consists in a combination of a fine toothing system and a coarse toothing system, in particular in combination with a tapering tooth shape of the coarse toothing system, which leads to better entrance behaviour in the case of coarse product constituents, in particular when the grinding stock comprises product constituents of differing size. As a result of the coarse toothing system, a greater tooth depth is formed on the inlet side. With the preliminary size reduction device according to the invention, therefore, a better pumping effect and/or turbulence is achieved, which prevents the grinding stock or product from sticking in the inlet region.

The finished first size reduction means, in particular the size reduction ring provided with an inner toothing system, is disposed and fixed in a grinding container of a ball-mill or agitator ball mill. The size reduction ring is disposed in such a way that it divides the interior space of the ball mill or agitator ball mill into a grinding chamber and a preliminary chamber. The second size reduction means is disposed and fixed on a rotatable shaft along a longitudinal axis of the grinding container, so that the first sub-region of the second size reduction means with the first outer teeth is disposed in such a way that the latter for the most part engage into the inner toothing system of the size reduction ring, thereby forming the size reduction gap forming a minimum distance. The second sub-region of the second size reduction means is then disposed in the preliminary chamber between the grinding stock inlet of the ball mill or agitator ball mill and the first size reduction means or grinding chamber.

The first size reduction means constituted stationary usually has an outer diameter which corresponds approximately to the inner diameter of the grinding container and is disposed and fixed in the grinding container. According to an embodiment of the invention, the second size reduction means is disposed and fixed on the rotatable agitator shaft of an agitator ball mill. When a preliminary size reduction device is used in a ball mill, its own drive is provided for the second size reduction means.

With the device according to the invention, the grinding stock for large mills, in particular of wet grinding mills, can advantageously undergo preliminary size reduction before it is worked further in the grinding chamber by the auxiliary grinding means. As a result of the course toothing system of the rotating size reduction means, the introduction of the grinding stock into the grinding chamber is also improved and residues of grinding stock in the preliminary chamber between the grinding stock Inlet and the grinding chamber are at least for the most part prevented.

The preliminary size reduction device according to the invention can be integrated directly during the assembly of mills into the latter. It is however also possible to retrofit mills subsequently with a preliminary size reduction device according to the invention, an existing preliminary size reduction device having to be previously dismantled where applicable.

BRIEF DESCRIPTION OF THE DRAWINGS

Examples of embodiment of the invention and its advantages are explained below in greater detail with the aid of the appended figures. The size ratios of the individual elements with respect to one another in the figures do not always correspond to the actual size ratios, since some forms are represented simplified and other forms are represented enlarged in relation to other elements for the sake of better illustration.

Identical reference numbers are used for identical or identically acting elements of the invention. Furthermore, for the sake of a clearer view, only reference numbers are represented in the individual figures that are required for the description of the respective figure. The represented embodiments only represent examples as to how the device according to the invention or the method according to the invention can be constituted and do not represent a conclusive limitation.

DETAILED DESCRIPTION

Figure 1:
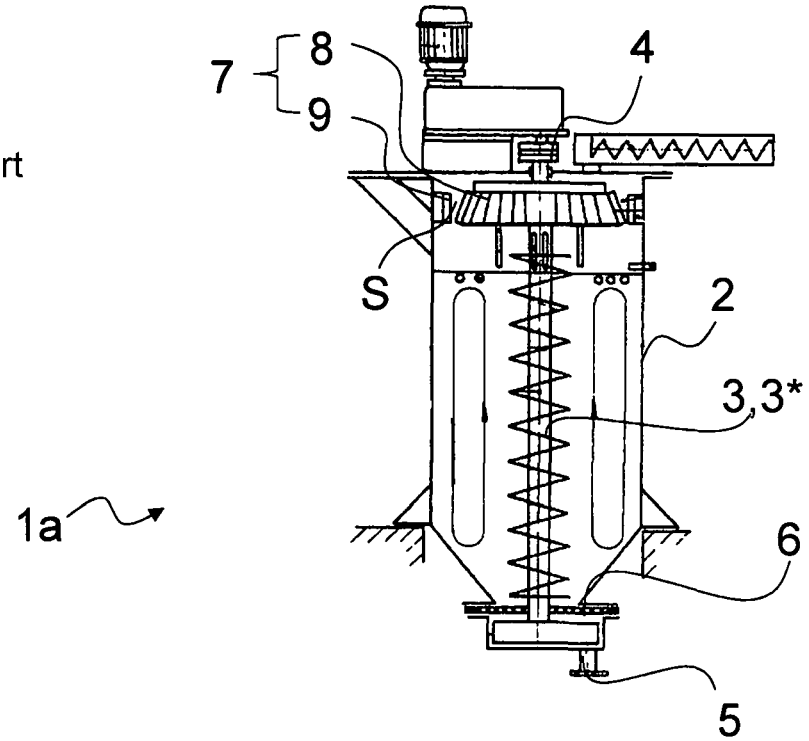
Fig.1 Prior Art
FIG. 1 shows a diagrammatic view of an agitator ball mill with a vertically disposed grinding container and agitator according to the prior art.

FIG. 1 shows a diagrammatic view of an agitator ball mill 1*a* with a vertically disposed grinding container 2 and an agitator 3 according to the prior art. Agitator ball mill 1*a* comprises and upper grinding stock inlet 4 and a lower grinding stock outlet 5, to which a separating device 6 is assigned. Separating device 6 holds back the grinding bodies (not represented) in grinding container 2. Agitator ball mill 1*a* further comprises a preliminary size reduction device 7 connected to agitator shaft 3* of agitator 3. Said preliminary size reduction device comprises a crushing cone 8, which is disposed rotationally fixed on agitator shaft 3*, and a crushing ring 9 fixed to grinding container 2. The grinding stock is introduced into crushing gap S between crushing cone 8 and crushing ring 9 and thereby undergoes preliminary size reduction, before it falls into grinding container 2, in which it is worked further by agitator 3 and the grinding bodies. The ground product is then removed via grinding stock outlet 5 from agitator ball mill 1*a*.

Figure 2:
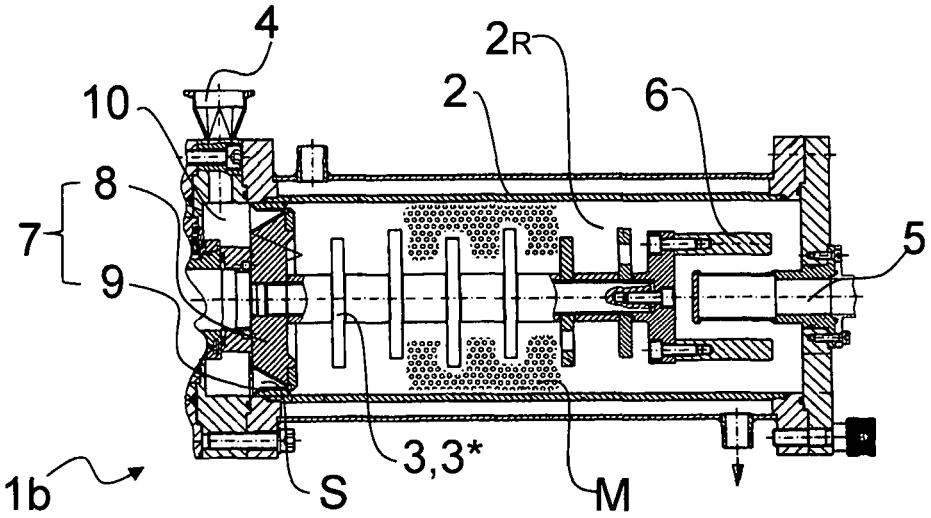
Fig.2 Prior Art
FIG. 2 shows a diagrammatic view of an agitator ball mill with a horizontally disposed grinding container and agitator according to the prior art.

FIG. 2 shows a diagrammatic view of a further agitator ball mill 1*b* with a horizontally disposed grinding container 2 and an agitator 3 according to the prior art. Agitator ball mill 1*b* comprises an upper grinding stock inlet 4 and a grinding stock outlet 5 disposed centrally on the opposite side of grinding container 2, a separating device 6 being assigned to said grinding stock outlet. Separating device 6 holds back grinding bodies M in grinding container 2. Agitator ball mill 1*b* also comprises a preliminary size reduction device 7 connected to agitator shaft 3*. Said preliminary size reduction device comprises a crushing cone 8, which is disposed rotationally fixed on agitator shaft 3* of agitator 3, and a crushing ring 9 fixed to grinding container 2. The grinding stock is introduced into crushing gap S between crushing cone 8 and crushing ring 9 and thereby undergoes preliminary size reduction before it passes into grinding container 2, in which it is worked further by agitator 3 and grinding bodies M. The ground product is then removed via grinding stock outlet 5 from agitator ball mill 1. Preliminary size reduction device 7 comprises a gap protection to grinding chamber 2R, said gap protection preventing grinding bodies M from being able to flow back and get into preliminary size reduction device 7.

Figure 6:
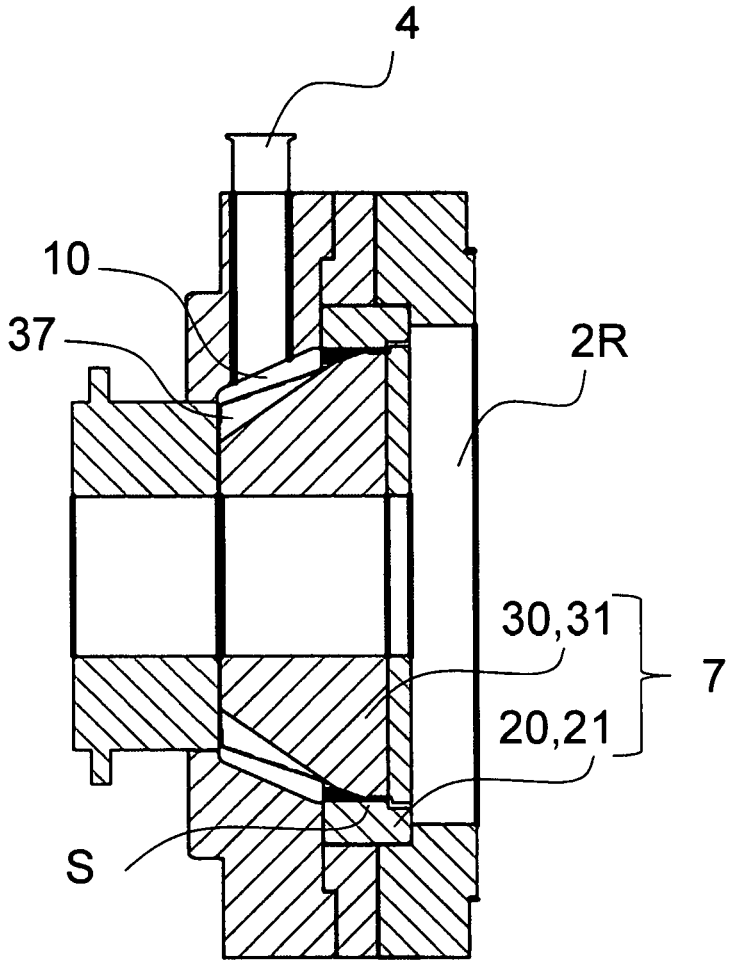
FIG. 6 shows a cross-section through a preliminary size reduction means according to the invention.

A preliminary size reduction device 7 according to the invention (see in particular FIG. 6) comprises a first size reduction means 20 constituted stationary (see FIGS. 3) and a second, rotationally mobile size reduction means 30 (see FIGS. 4), between which a size reduction gap S is formed. In particular, first size reduction means 20 is constituted as a so-called size reduction ring 21 and second size reduction means 30 is constituted as a so-called elongated truncated cone 31. The preliminary size reduction device is disposed inside the mill between grinding stock inlet 4 and grinding chamber 2R (see also FIGS. 1, 2 and 6), in such a way that second size reduction means 30 on the side facing towards grinding chamber 2R engages at least partially into first size reduction means 20, thereby forming size reduction gap S, so that the grinding stock has to pass through size reduction gap S when it enters into grinding chamber 2R, whereby it undergoes preliminary size reduction.

Figure 3A:
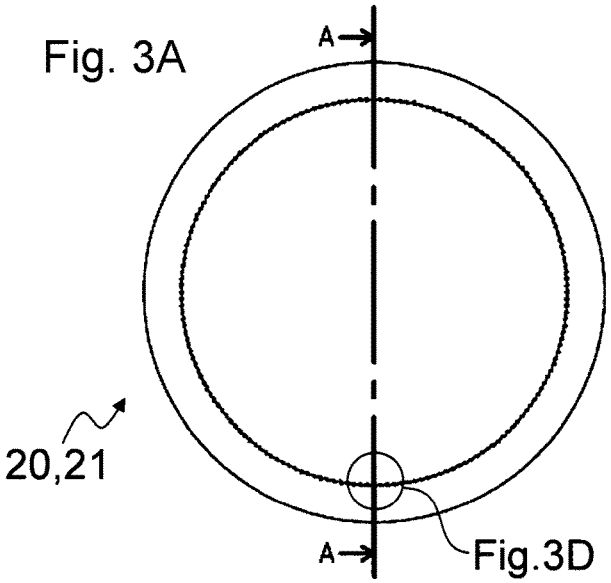
FIGS. 3A-3D show various views of a first size reduction means of a preliminary size reduction device according to the invention.
Figure 3B:
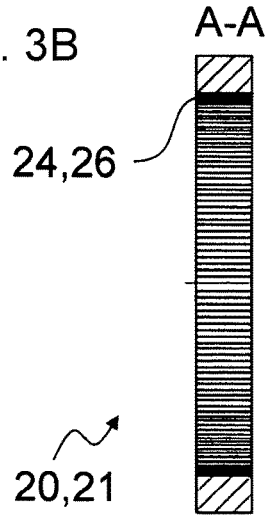

FIGS. 3 show various views of a first size reduction means 20 of a preliminary size reduction device according to the invention, in particular FIG. 3B represents a cross-section along intersecting line A-A according to FIG. 3A. First size reduction means 20 is constituted in particular as size reduction ring 21. Inner circumferential surface 24 of size reduction ring 21 comprises a so-called inner toothing system comprising inner teeth 26.

Figure 3C:
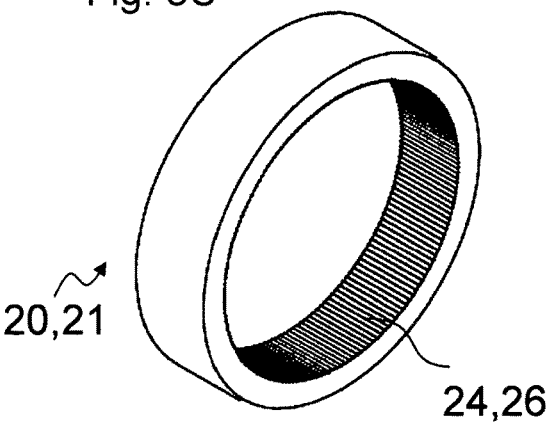
Figure 3D:
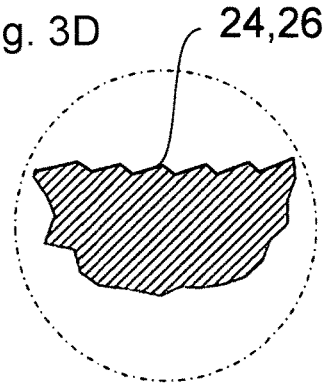

FIG. 3C shows a perspective view of first size reduction means 20 constituted as a size reduction ring 21 and FIG. 3D shows a detail from FIG. 3A. In particular, the inner toothing system in inner circumferential surface 24 can clearly be seen here with fine inner teeth 26.

Figure 4A:
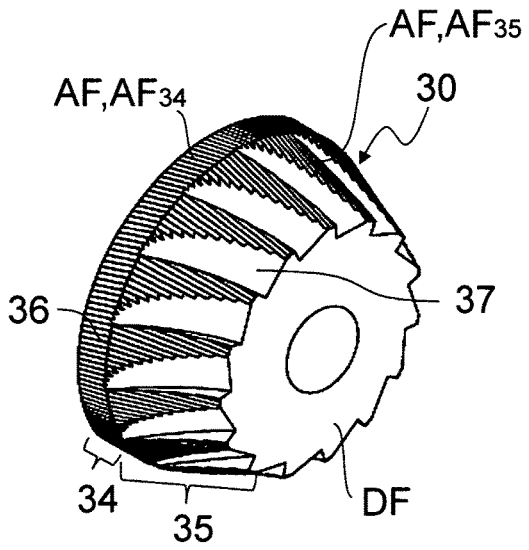
FIGS. 4A-4E show various views of a second size reduction means of a preliminary size reduction device according to the invention.
Figure 4B:
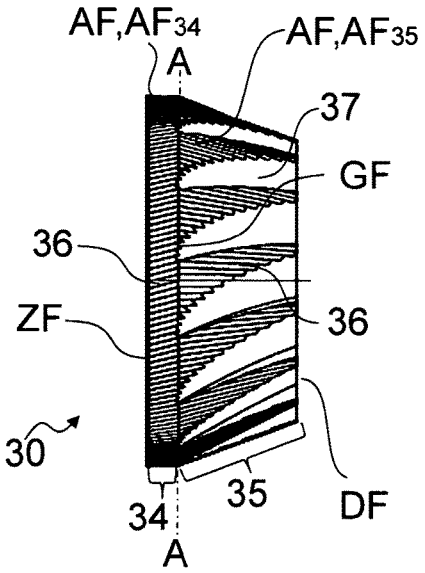
Figure 4C:
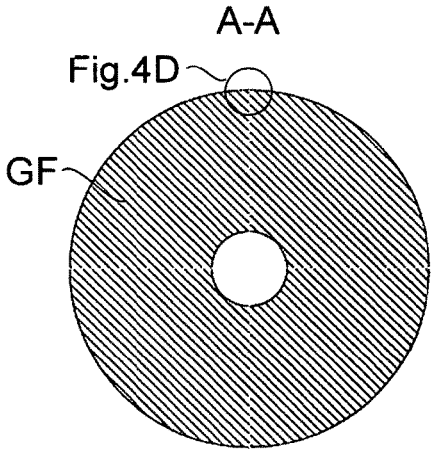
Figure 4D:
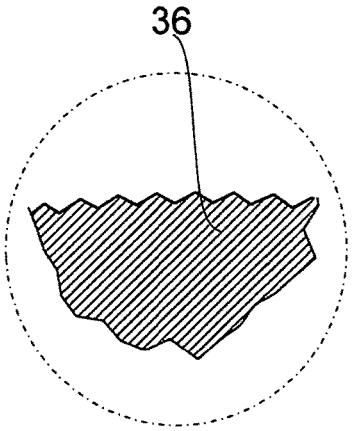
Figure 4E:
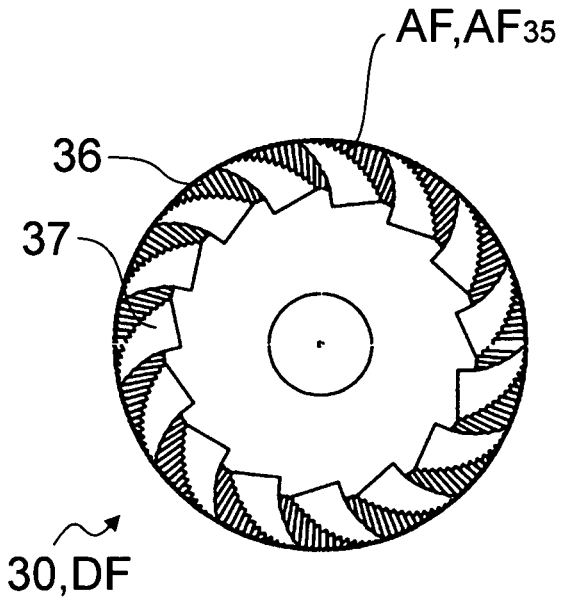

FIGS. 4 show various views of a second size reduction means 30 of a preliminary size reduction device according to the invention, in particular FIG. 4C represents a cross-section along intersecting line A-A according to FIG. 4B. FIG. 4D shows a detail from FIG. 4C. FIG. 4E shows a plan view of second size reduction means 30 onto a top face DF.

Second size reduction means 30 comprises a region constituted as truncated cone 35 and a cylindrical region 34. The region constituted as truncated cone 35 has a bottom face GF, a top face DF and an outer lateral surface AF35. Cylindrical region 34 comprises a cylindrical bottom face ZF with the same cross-section or the same diameter as bottom face GF of truncated cone 35 and an outer lateral surface AF34.

Second size reduction means 30 comprises, at least in sections, first outer teeth 36. Furthermore, second size reduction means 30 comprises, at least in sections, second outer teeth 37. In particular, second size reduction means 30 comprises a first cylindrical region 34, with first teeth 36 having a first material thickness and/or material height and a second truncated cone-like region 35 with first teeth 36 and second teeth 37 having a second material thickness and/or material height and wherein the first material thickness and/or material height is smaller than the second material thickness and/or material height. In particular, the first material thickness and/or material height of fine outer teeth 36 of second size reduction means 30 correspond at least for the most part to the material thickness and/or material height of inner teeth 26 of size reduction ring 21 (see also FIGS. 3).

So-called coarse teeth 37 of second size reduction means 30 are constituted much thicker in the entrance region of preliminary size reduction device 7 than fine teeth 36 of second size reduction means 30 and/or fine inner teeth 26 of first size reduction means 20 or size reduction ring 21. Second coarse teeth 37 in second region 35 of second size reduction means 30 also have a tapering tooth shape. In particular, the tooth shape tapers in the direction of the free end region of second size reduction means 30 facing away from size reduction ring 21 or in the direction of a top face DF of the second region of second size reduction means 30 constituted as truncated cone 35.

According to a preferred embodiment, fine teeth 36 extend over the outer lateral surfaces of coarse outer teeth 37. Coarse particles of the grinding stock can be better picked up and undergo preliminary size reduction as a result of coarser second outer teeth 37 of second size reduction means 30. The overall preliminary size reduction device is constituted and disposed between grinding stock inlet 4 and grinding chamber 2R in such a way (see also FIGS. 2 and 6) that as far as possible no dead space is formed, in order to prevent the jamming of coarse particles and/or impurities due to the grinding stock.

According to an optional embodiment of the invention, the sides delimiting the outer lateral surface of coarse outer teeth 37 have a curved course. In particular, one of the two sides has a more marked curvature, as a result of which the widening of outer teeth 37 in the direction of adjacent cylindrical sub-region 34 is formed.

Figure 5:
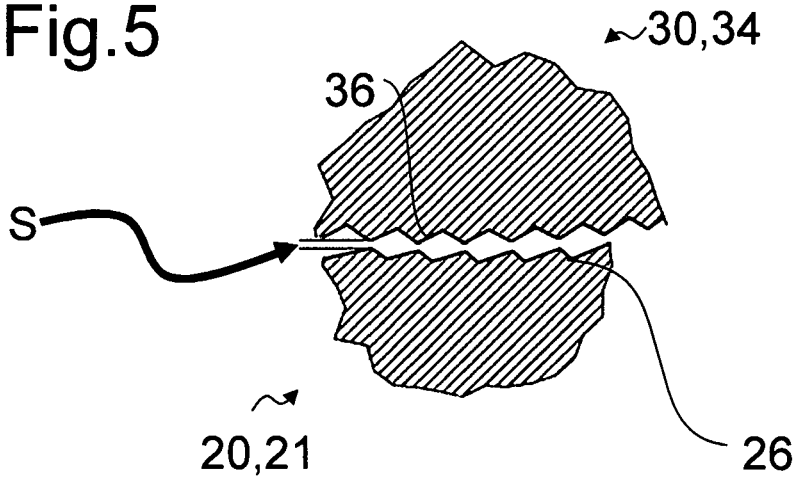
FIG. 5 shows a detail of the toothing system between the first size reduction means and the second size reduction means.

FIG. 5 shows a detail of the toothing system between first size reduction means 20 and second size reduction means 30, in particular fine inner teeth 26 of size reduction ring 21 and fine outer teeth 36 of cylindrical region 34 of second size reduction means 30. Fine inner teeth 26 and fine outer teeth 36 for the most part engage into one another, thereby forming a size reduction gap S. Size reduction gap S defines a minimum distance between fine inner teeth 26 of size reduction ring 21 and fine outer teeth 36 of cylindrical region 34 of second size reduction means 30, so that the grinding stock entering via size reduction gap S into grinding chamber 2R (see FIGS. 1, 2 and 6) undergoes preliminary size reduction. The combination of a fine toothing system 26, 36 and a coarse toothing system 37, in particular in combination with a tapering tooth shape of coarse toothing system 37, leads to an improved entrance behaviour in the case of coarse product constituents, in particular when the grinding stock comprises product constituents of differing size. In addition, a greater tooth depth is formed on the inlet side by coarse toothing system 37. With the preliminary size reduction device according to the invention, therefore, a better pumping effect and/or turbulence is achieved, which prevents the product from sticking in inlet region 10 (see FIGS. 2 and 6).

The invention has been described by reference to a preferred embodiment. A person skilled in the art can however imagine that modifications or changes to the invention can be made without thereby departing from the scope of protection of the following claims.

What is claimed is:

1. A preliminary size reduction device for a ball mill or agitator ball mill comprising, a first size reduction means being stationary, a second size reduction means being rotationally mobile, a size reduction gap between the first size reduction means and second size reduction means, wherein the preliminary size reduction device is positionable between a grinding stock inlet of the ball mill or agitator ball mill and a grinding chamber, wherein the first size reduction means is a size reduction ring disposable in a grinding container, wherein the first size reduction means comprises an inner toothing system, wherein the second size reduction means comprises a first sub-region and a second sub-region, wherein the second sub-region guides grinding stock in the direction of the first sub-region, wherein the first sub-region of the second size reduction means comprises a first outer toothing system, and wherein the first sub-region of the second size reduction means is constituted as a cylindrical region;

wherein the first size reduction means and the second size reduction means are configured in such a way that the outer toothing system of the first sub-region of the second size reduction means engages into the inner toothing system of the first size reduction means, thereby forming the size reduction gap.

2. The preliminary size reduction device according to claim 1, wherein the second size reduction means in the second sub-region comprises a second outer toothing system with second outer teeth, wherein the second outer teeth have a second tooth height and width, which is greater than a first tooth height and width of first outer teeth of the first outer toothing system in the first sub-region of the second size reduction means, and wherein the second outer toothing system guides the grinding stock.

3. The preliminary size reduction device according to claim 2, wherein the tooth width of the second outer teeth increases from a free end of the second sub-region in the direction of the adjacent first sub-region.

4. The preliminary size reduction device according to claim 2 further comprising, a first side and a second side delimiting an outer surface of the second outer teeth have a curved course, wherein the first side has a more marked curvature than the second side.

5. The preliminary size reduction device according to claim 2, wherein the first outer toothing system of the first sub-region of the second size reduction means is continued over outer surfaces of the second outer toothing system of the second sub-region of the second size reduction means.

6. The preliminary size reduction device according to claim 2, wherein the second sub-region of the second size reduction means is constituted in the form of a truncated cone with a truncated cone bottom face and a truncated cone top face, and wherein the first sub-region of the second size reduction means has a cylindrical bottom face, wherein the truncated cone bottom face and the cylindrical bottom face are the same size and wherein the cylindrical region with a cylindrical bottom face lies adjacent to the truncated cone bottom face of the truncated cone region.

7. The preliminary size reduction device according to claim 6, wherein the tooth width of the second outer teeth increases from the truncated cone top face of the truncated cone region in the direction of the cylindrical region.

8. The preliminary size reduction device according to claim 6, wherein the outer toothing system of the cylindrical region of the second size reduction means is continued over the outer surface of the second outer toothing system of the truncated cone region of the second size reduction means.

9. An agitator ball mill comprising:

a preliminary size reduction device between a grinding stock inlet of the agitator ball mill and a grinding chamber, wherein the preliminary size reduction device comprises a first size reduction means constituted stationary and a second, rotationally mobile size reduction means, between which a size reduction gap is formed, wherein the first size reduction means constituted stationary is a size reduction ring disposed in the grinding chamber, wherein the first size reduction means constituted stationary comprises an inner toothing system and that the second size reduction means comprises a first sub-region and a second sub-region, wherein the second sub-region comprises guiding structures for grinding stock, by means of which the grinding stock can be guided in the direction of the first sub-region, and wherein at least the first sub-region of the second size reduction means comprises a first outer toothing system, wherein the first sub-region of the second size reduction means is constituted as a cylindrical region, and wherein the first size reduction means and the second size reduction means are disposed in such a way that the outer toothing system of the first sub-region of the second size reduction means engages into the inner toothing system of the first size reduction means, thereby forming the size reduction gap.

10. The ball mill, in particular the agitator ball mill, according to claim 9, wherein the second size reduction means in the second sub-region comprises a second outer toothing system with second outer teeth, wherein the second outer teeth have a second tooth height and width, which is greater than a first tooth height and width of first outer teeth in the first sub-region of the second size reduction means and wherein the second outer toothing system are the guiding structures for the grinding stock.

11. The preliminary size reduction device according to claim 3 further comprising, a first side and a second side delimiting an outer surface of the outer teeth have a curved course, wherein the first side has a more marked curvature.

12. The preliminary size reduction device according to claim 6, wherein the second outer toothing system is in the region of an outer lateral surface between the truncated cone top face and the truncated cone bottom face.

13. A preliminary size reduction device for a ball mill or agitator ball mill comprising;

a stationary size reduction ring disposable in a grinding container having an inner toothing system;

a second size reduction means being rotationally mobile having a first sub-region having a cylindrical shape with an outer toothing system and a second sub-region;

wherein the second sub-region guides grinding stock in the direction of the first sub-region;

wherein the inner toothing system of the size reduction ring and the outer toothing system of the first sub-region of the second size reduction means engage to form a size reduction gap; and wherein the preliminary size reduction device is positionable between a grinding stock inlet of the ball mill or agitator ball mill and a grinding chamber.

14. The preliminary size reduction device according to claim 6, wherein the tooth height of the second outer teeth diminishes in the direction of the cylindrical region.

15. The preliminary size reduction device according to claim 2, wherein the tooth height of the second outer teeth diminishes in the direction of the adjacent first sub-region.

* * * * *